United States Patent [19]

Mangal

[11] Patent Number: 4,563,849

[45] Date of Patent: Jan. 14, 1986

[54] DEVICE FOR INTERLOCKING TOGETHER TWO ADJACENT METAL FRAMES FROM TWO DIFFERENT LEVELS

[75] Inventor: Michel Mangal, Bois d'Haine, Belgium

[73] Assignee: SADACEM, Belgium

[21] Appl. No.: 596,585

[22] Filed: Apr. 4, 1984

[30] Foreign Application Priority Data

Apr. 14, 1983 [BE] Belgium ..... 0/210554

[51] Int. Cl.[4] ..... E04H 1/00

[52] U.S. Cl. ..... 52/235; 52/573; 52/595

[58] Field of Search ..... 52/235, 236.3, 573, 52/595, 167; 404/67-69

[56] References Cited

FOREIGN PATENT DOCUMENTS

| | | | |
|---|---|---|---|
| 1275756 | 8/1968 | Fed. Rep. of Germany | 52/235 |
| 2250067 | 5/1974 | Fed. Rep. of Germany | 52/235 |
| 928673 | 6/1963 | United Kingdom | 52/235 |
| 619695 | 8/1978 | U.S.S.R. | 52/595 |

*Primary Examiner*—Carl D. Friedman
*Assistant Examiner*—Naoko N. Slack
*Attorney, Agent, or Firm*—Scully, Scott, Murphy & Presser

[57] ABSTRACT

There is described a device for interlocking together two adjacent metal frames from two different levels in a "glass skin", fitted on the framework of a building, whereon said frames are mounted either rigidly or flexibly, the components of said device having to be mounted on two frame sections which are horizontally adjacent in mounting position, which is comprised on the one hand of a male part integral with a section from the one frame, and on the other hand of a female part integral with a section from an adjacent frame which is mounted in use position, in an adjacent level, the female part having a lengthwise recess extending in mounting position, in parallel relationship with the general plane of the frame under consideration, in such a way that under the action of a translation movement of the one frame relative to another one, made in that general plane both said frames lie in, the male part is free to perform a translation and/or rotating movement relative to the female part, while both adjacent frames are joined for the movement thereof in a plane at right angle to the general plane thereof, that is in a plane at right angle to the "glass skin" formed by all of said frames together, the device components insuring the transfer of the stresses from the one frame to the other in the plane at right angle to the front wall.

2 Claims, 1 Drawing Figure

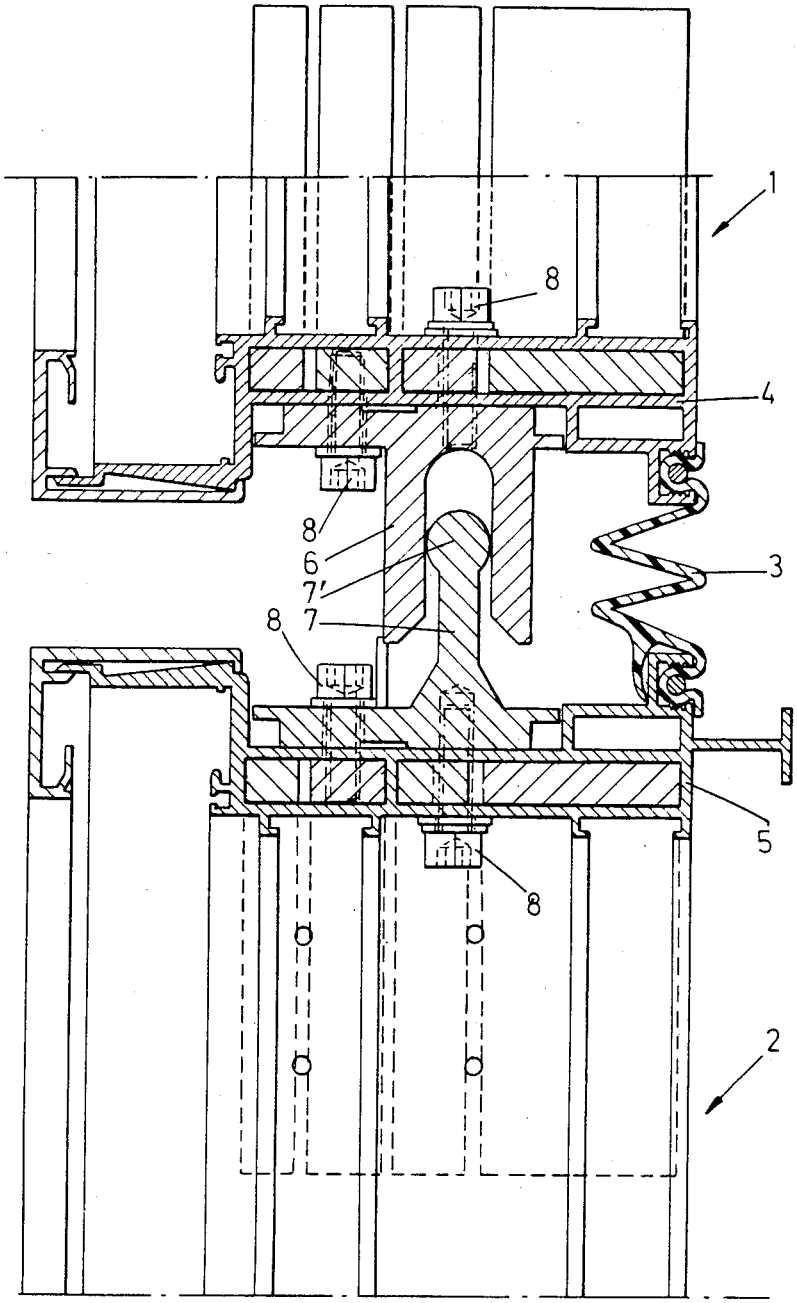
1
8
4
8
6
7'
3
8
7
5
8
2

DEVICE FOR INTERLOCKING TOGETHER TWO ADJACENT METAL FRAMES FROM TWO DIFFERENT LEVELS

This invention pertains to a device for interlocking together two adjacent metal frames from two different levels in a "glass skin", fitted on the framework of a building, whereon said frames are mounted either rigidly or flexibly, the components of said device having to be mounted on two frame sections which are horizontally adjacent in mounting position.

The wording "glass skin" designates the whole unit of the glazed frames secured to the framework of a steel or reinforced-concrete building, it may be considered as the equivalent of "curtain wall".

Men of the art know quite well the stresses which are imparted to the glazed structure due to the distortions undergone by the frame work, either under the action of the foundation settling, or under the action of the building structure distortions under the fixed and movable loads, or else due to the association of both these phenomenoms. Earth tremors however small they be, are of course to be taken into account among the phenomenoms requiring very particular solutions, allowing the glazed frames to move without damage, relative to the building framework they are provided in.

The movements of the frames relative to one another in the general plane of the so-called "glass skin", thus require uncommon solutions.

Up to now the glazed frames have generally been mounted rather rigidly in succeeding rows along the vertical directions, by guiding each frame relative to the lower frame. In this direction, pins secured to the lower horizontal section of a frame slide during the mounting of a frame part of a lower row, into receiving openings or members provided on the upper part of a lower row.

This assembly may possibly be associated with a system for hanging each frame from the building framework, by means of a compensation bar bearing in one single supporting point integral with the building framework.

In such conditions, the flexibility of the "glass skin" is not high enough to avoid major damages to the filling elements should there be large movements in the framework, due notably to earth tremors.

The Applicant has already described the previous art and various means for improving same in Belgian Pat. Nos. 825,631 and 839,314.

The invention has for object to provide a device allowing to interlock together adjacent metal frames from two different levels, which insure the highest possible flexibility in the very plane of the "glass skin" as well as a hinge movement between two frames from adjacent levels lying in one and the same vertical row.

For this purpose, the device according to the invention is essentially comprised on the one hand of a male part integral with a section from the one frame, and on the other hand of a female part integral with a section from an adjacent frame which is mounted in use position, in an adjacent level, the female part having a lengthwise recess extending in mounting position, in parallel relationship with the general plane of the frame under consideration, in such a way that under the action of a translation movement of the one frame relative to another one, made in that general plane both said frames lie in, the male part is free to perform a translation and/or rotation movement relative to the female part, while both adjacent frames are joined for the movement thereof in a plane at right angle to the general plane thereof, that is in a plane at right angle to the "glass skin" formed by all of said frames together, the device components insuring the transfer of the stresses from the one frame to the other in the plane at right angle to the front wall.

In a preferred embodiment, said female part has in cross-section a U-trough shape.

Still according to the invention, said male part has an enlarged end the diameter of which is slightly smaller than the spacing between the inner walls of said U-shaped trough, to allow a hinging movement of the one frame relating to the other.

Other details and features of the invention will stand out from the following description given by way of non limitative example and with reference to the accompanying drawing, the single FIGURE of which is a cross-section view through the device according to the invention as mounted between the lower cross-member of an upper frame and the upper cross-member of the frame being part of the lower level.

The device as shown in section in said figure is intended to interlock together two adjacent frames arranged on top of one another in a vertical row, the upper frame being shown generally in 1 and the lower frame being generally shown in 2, and both frames are made fast to a building framework. Said framework has not been shown in the FIGURE. To hang each frame from the building, use may be made of a system which comprises a compensation bar bearing for example in a single center point on a supporting element anchored in the building framework and not shown in the drawing.

On the outer side, the spacing between both frames is closed by sealing elements 3, preferably made from synthetic rubber in a W-shape.

Such sealing method and the profiles of the sealing elements have been previously developed by the Applicant. Such elements are not part of this application.

Each frame is moreover secured in position relative to the building framework by means of members for receiving the wind action. Such members have also been developed by the Applicant and they are so designed as to insure some "floating" of the "glass skin" relative to the building framework fitted with glazed frames.

Up to now, each frame being part of a lower level has been interlocked with the frame which is part of the level lying directly above or next thereto due to the upper horizontal cross-members of a lower frame being fitted with pins which did enter during the mounting, receiving openings or cut-outs provided for said pins in the lower cross-member of a frame which is part of a higher level. The word "level" is to be understood as meaning a horizontal frame row, with the understanding that a frame may presently have such a size as to correspond to more than one level of the building proper.

To allow mostly during earth tremors, a vertical displacement or a translation movement of the one frame relative to a higher frame, in the plane of the front wall or a rotating of the one frame relative to the other one, the cross-members facing one another in two adjacent frames, for example cross-member 4 from frame 1 and cross-member 5 from frame 2, are respectively fitted with a female part 6 and a male part 7 which comprise together the device according to the invention.

The female part 6 has essentially a U-trough shape in cross-section, which comprises an inverted trough in use position, in which enters said male part 7 which is secured as stated above, to the upper cross-member of frame 2. The male and female parts 7 and 6 are for example secured with a bolt 8. In the lengthwise direction, the trough-shaped female part 6 is preferably longer than male part 7 and the outer diameter of the bulging or enlarged end 7' of the male part is substantially equal to the spacing between the inner surface of the trough comprised of said female part 6.

It is clear that not only horizontal and vertical translation movements of frame 2 relative to frame 1, in a plane which substantially corresponds to the glass skin plane, are possible, but also a hinging movement in a plane at right angle thereto.

With reference to the single FIGURE, it is to be noted that frames 1 and 2 have been shown in the normal static position thereof, that is exactly in the same plane.

In reality during a more or less important movement, notably during more or less heavy earth tremors, the plane of frame 1 may lie at an angle to the plane of frame 2. The male element 7 and notably the end 7' thereof may act as a swivel-joint inside the walls of female element 6 and form a hinge.

It is thus clear that the frames and the fill-up elements will easily bear without damage, movements of adjacent frames from frame levels in a row, perform a translation movement relative to the frames from an adjacent row, but also a hinging movement, that is generally in a plane at right angle to the general plane of the glass skin.

It must be understood that the invention is in no way limited to the above embodiments and that many changes may be brought therein without departing from the scope of the invention as defined by the appended claims.

I claim:

1. A device for interlocking two adjacent metal frames from two different levels, said frame being rigidly or flexibly mounted to a framework of a building forming a glass skin said device comprising:

a female part integral with a first metal frame, said female part having a lengthwise recess section projecting from said metal frame in parallel relationship with the general frame plane;

a male part integral with a second metal frame on a vertically adjacent level with said first metal frame, said male part projecting from said second metal frame and extending within said lengthwise recess section, said male part including an enlarged end having a diameter slightly smaller than the spacing between the inner walls of said recess section;

whereby under the action of a translational movement of one frame relative to another, said male part is free to perform a translational and/or rotational movement relative to said female part in the general plane of said frames and said male part is free to perform a hinging movement relative to said female part in a plane at a right angle to the building framework.

2. Device as defined in claim 1, in which said female part has in cross-section, a U-trough shape.

* * * * *